US006478087B2

(12) United States Patent
Allen

(10) Patent No.: US 6,478,087 B2
(45) Date of Patent: Nov. 12, 2002

(54) APPARATUS AND METHOD FOR SENSING THE PROFILE AND POSITION OF A WELL COMPONENT IN A WELL BORE

(75) Inventor: Timothy J. Allen, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/797,020

(22) Filed: Mar. 1, 2001

(65) Prior Publication Data

US 2002/0121369 A1 Sep. 5, 2002

(51) Int. Cl.[7] ..... E21B 47/09; E21B 29/12

(52) U.S. Cl. ..... 166/255.1; 166/250.01; 166/66; 166/336; 340/853.1; 340/854.1

(58) Field of Search ..... 166/336, 255.1, 166/250.01, 66, 348; 73/625, 628, 634; 340/853.1, 853.2, 854.1, 854.5; 367/140, 141

(56) References Cited

U.S. PATENT DOCUMENTS

| | | | | | |
|---|---|---|---|---|---|
| 2,999,557 | A | * | 9/1961 | Smith et al. | 367/181 |
| 3,103,976 | A | * | 9/1963 | De Vries et al. | 166/255.1 |
| 4,121,657 | A | * | 10/1978 | McClure | 166/66 |
| 4,206,810 | A | * | 6/1980 | Blackman | 166/336 |
| 4,291,761 | A | * | 9/1981 | Watson | 166/66 |
| 4,314,365 | A | | 2/1982 | Peterson et al. | 367/82 |
| 4,715,442 | A | * | 12/1987 | Kahil et al. | 166/250.01 |
| 4,862,426 | A | | 8/1989 | Cassity et al. | 367/81 |
| 4,922,423 | A | * | 5/1990 | Koomey et al. | 166/373 |
| 4,964,462 | A | * | 10/1990 | Smith | 166/255.1 |
| 4,989,671 | A | * | 2/1991 | Lamp | 137/624.2 |
| 5,014,781 | A | * | 5/1991 | Smith | 166/384 |
| 5,492,017 | A | * | 2/1996 | Jennings et al. | 73/722 |
| 5,826,654 | A | * | 10/1998 | Adnan et al. | 166/250.01 |
| 6,269,875 | B1 | * | 8/2001 | Harrison et al. | 166/53 |
| 6,359,569 | B2 | * | 3/2002 | Beck et al. | 166/250.01 |

FOREIGN PATENT DOCUMENTS

| | | |
|---|---|---|
| DE | 200 08 413.5 | 5/2000 |
| WO | WO 01/86116 A1 | 11/2001 |

* cited by examiner

*Primary Examiner*—Robert E. Pezzuto
*Assistant Examiner*—Thomas A. Beach
(74) *Attorney, Agent, or Firm*—Michael P. Hartmann; Peter A. Bielilnski

(57) ABSTRACT

A method and apparatus for sensing the profile and position of a well component in a well bore and transmitting this information to a surface mounted display unit to aid an operator in performing subsea well operations. The apparatus includes an instrumented flange with appropriate end connections to allow connecting the flange between the annular preventer and the drilling riser. The instrumented flange is sufficiently long to allow a first plurality of sensor units to be arranged circumferentially around the axial bore of the flange in a single plane and a second plurality of sensor units to be arranged in a helical pattern along the axis of the flange. The output signals of the sensor units are processed at a signal processing unit which then transmits the information to a display unit at the surface.

22 Claims, 3 Drawing Sheets

APPARATUS AND METHOD FOR SENSING THE PROFILE AND POSITION OF A WELL COMPONENT IN A WELL BORE

BACKGROUND OF THE INVENTION

1. Field of the Invention

This invention relates to an apparatus and method for sensing the profile and position of a well component, such as a tool joint or casing hanger in the well or riser bore. This information is invaluable in aiding an operator to determine if a well component is in the correct position, i.e., has the casing hanger properly landed in the wellhead housing or is it sitting high in the well bore. Similarly, the current invention can aid an operator in knowing if a tool joint or the straight outside diameter of the drill pipe is in the bore of a blowout preventer when it is time to close the rams of the blowout preventer.

The operation and placement of well components in a well bore, riser bore or blowout preventer stack is critical in oil and gas drilling operations. This is particularly true in the offshore environment where nonproductive time is very expensive. Typical operations where the present invention is applicable include the landing of a casing hanger on the subsea wellhead seat, the proper positioning and setting of the annular seal between the subsea wellhead and casing hanger or the positioning of a well component such as a test plug or tool joint at a particular level or orientation in a wellhead or blowout preventer stack.

Until recently, such operations depended on such indications as a running tally of the length of the running string or drill pipe used to lower well components into the well bore. These pipe tallies were notoriously inaccurate and as drilling requirements with regard to positioning of well components has grown more exacting, such methods of locating well components are unacceptable. Furthermore, as offshore drilling operations has moved into deeper waters, e. g., greater that 4,000 feet, more accurate methods of determining well component placement and their profiles have been needed.

Some prior advancements in drilling technology had allowed somewhat more accurate determination of well component positioning. These methods included requiring running wires from the area of the well bore to be surveyed to the water surface. This method is difficult to use in practice because of the greater water depths involved and the long lengths of wire required.

2. Description of Related Art

U.S. Pat. No. 4,314,365 to C. W. Petersen et al. shows a system for transmitting and detecting acoustic signals along a drill pipe string.

An improved method and apparatus for operating equipment in a subsea environment is disclosed in U.S. Pat. No. 4,862,426 to T. G. Cassity et al. This apparatus uses acoustic or ferrous metal detectors to determine if certain operations such as landing a casing hanger are completed.

German Utility Model Application No. 200 08 413.5 to K. Biester et al. shows a system for detecting tool joints using magnetic detection units in a planar arrangement.

SUMMARY OF THE INVENTION

The apparatus and method for sensing the profile and position of a well component in a well bore of the present invention is designed for use in a standard ram-type blowout preventer stack used in oil and gas drilling operations. The typical blowout preventer stack includes a pair of double ram preventers positioned together with an annular or "bag" type blowout preventer positioned above the double ram preventers. The apparatus of the present invention includes an instrumented flange with appropriate end connections to allow connecting the flange between the annular preventer and the drilling riser.

The instrumented flange is sufficiently long to allow a first plurality of sensor units to be arranged circumferentially around the axial bore of the flange in a single plane and a second plurality of sensor units to be arranged in a helical pattern along the axis of the flange. The sensor units are positioned in radially disposed pockets in the bore of the instrumented flange, but do not protrude into the bore. The pockets in which the sensor units are positioned are sealed to maintain the pressure integrity of the instrumented flange and the well bore.

Wires exit the rear of the sensor units and terminate at a signal processing unit where the output signals of the sensor units are processed. This processed information is then transmitted to a display unit at the surface whereby an operator can determine the profile and position of a well component as it passes through the instrumented flange. The present invention envisions the sensor units could be acoustic transducers, ultrasonic transducers or optical transducers or a combination thereof.

An alternative embodiment is also shown with either acoustic or ultrasonic transducers positioned on the exterior of the instrumented flange.

A principal object of the present invention is to provide a method and apparatus for sensing the profile and position of a well component in a well bore and transmitting this information to a surface mounted display unit to aid an operator in performing subsea well operations.

Another object of the present invention is to provide a method and apparatus for sensing the profile and position of a well component in a well bore utilizing acoustic, ultrasonic or optical sensors and thereby be able to sense both non-magnetic and magnetic well components.

A final object of the present invention is to provide a method and apparatus for sensing the profile and position of a well component in a well bore without requiring specialized configuration blowout preventers.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENTS

Figure 1:
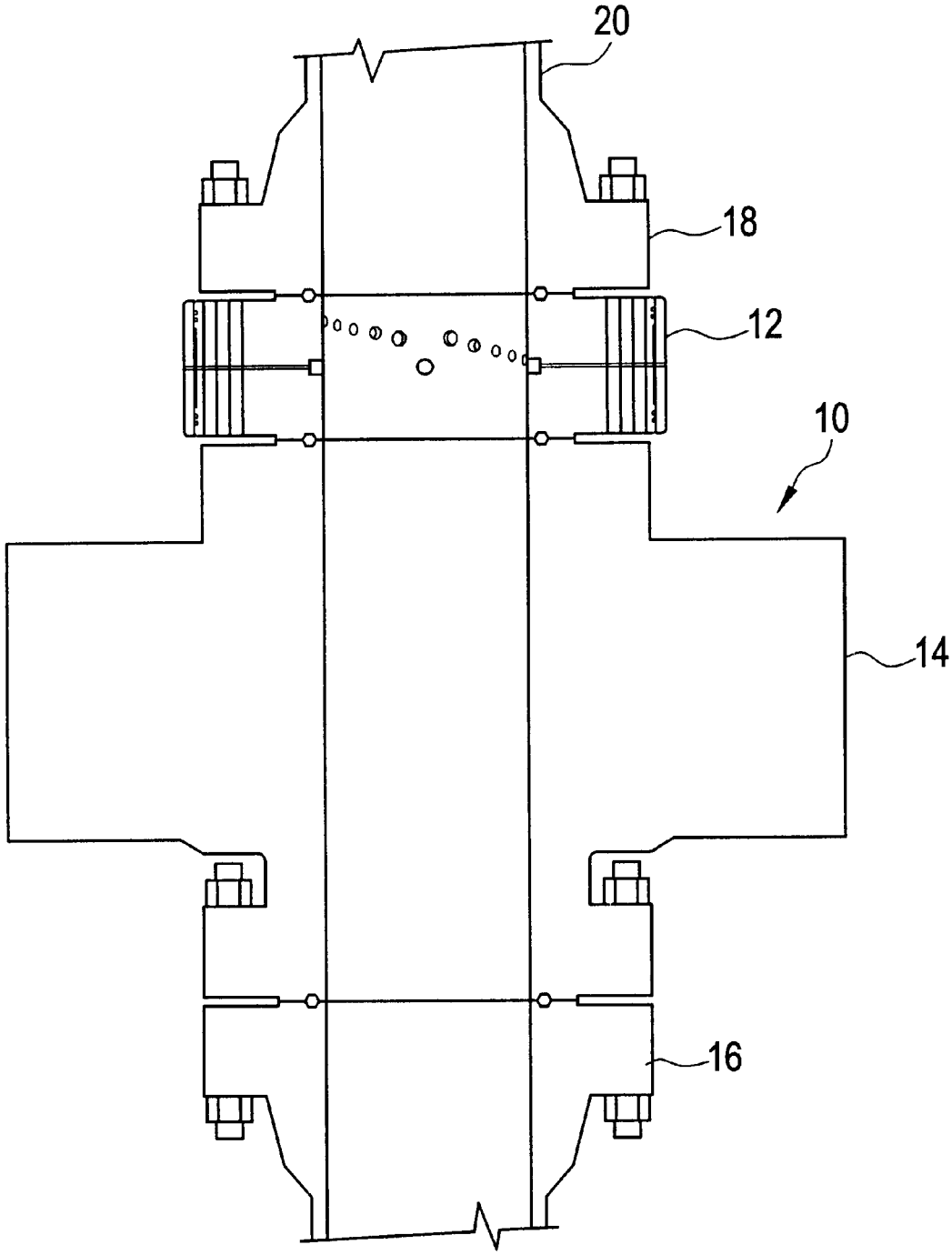
FIG. 1 is an elevation view in section of a portion of a blowout prevent stack with the instrumented flange of the present invention therein.

With reference to the drawings, and particularly to FIG. 1, an elevation view in section of a portion of a typical subsea blowout preventer stack 10 with the instrumented flange or outer container 12 of the present invention therein is shown. Subsea blowout preventer stack 10 includes annular or "bag" type blowout preventer 14 which is connected to ram type blowout preventer 16 (shown partially) and well known to those of ordinary skill in the art by suitable means as bolting. Instrumented flange or outer container 12 is shown as being connected between annular blowout preventer 14 and flanged connection 18 of drilling riser 20. Drilling riser 20 extends to the surface and is connected to a suitable drilling vessel (not shown) by means well known to those of ordinary skill in the art. Although shown in the context of a subsea blowout preventer stack 10, the present invention would be equally valuable in a system used in land drilling. Additionally, while instrumented flange or outer container 12 is shown as a conventional flange equivalent modifications such as the flange having a non-circular cross-section, different end connections or in fact being incorporated into a blowout preventer end connection are envisioned by the current invention.

Figure 2:
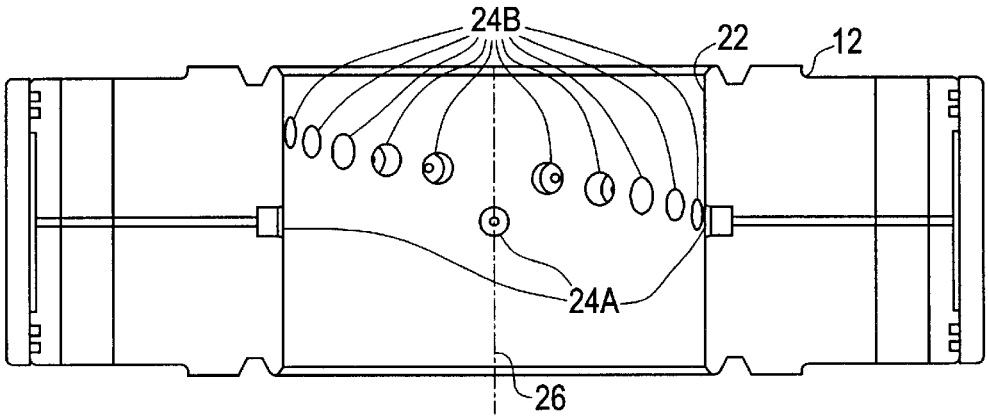
FIG. 2 is an elevation view in section of the instrumented flange showing the positioning of the sensor units therein.

Instrumented flange or outer container 12 is shown in an elevation view in section in FIG. 2 to aid in understanding the positioning of the sensor units therein. Instrumented flange or outer container 12 includes bore or conduit 22 extending therethrough. Conduit 22 is sized to match the bores of drilling riser 20 and subsea blowout prevent stack 10 to allow well components such as casing hangers, annular seal assemblies or downhole tools to pass unimpeded. Positioned within bore or conduit 22 of instrumented flange or outer container 12 are a plurality of sensor units 24. Sensor units 24 may be acoustical, ultrasonic or optical transducers, depending on the information to be obtained. A portion or first plurality of sensor units, denoted by 24A, are arranged circumferentially around conduit 22 in a single plane. A second portion or second plurality of sensor units, denoted by 24B, are arranged in a helical pattern extending around bore or conduit 22 and along axis 26 of instrumented flange or outer container 12.

Figure 3:
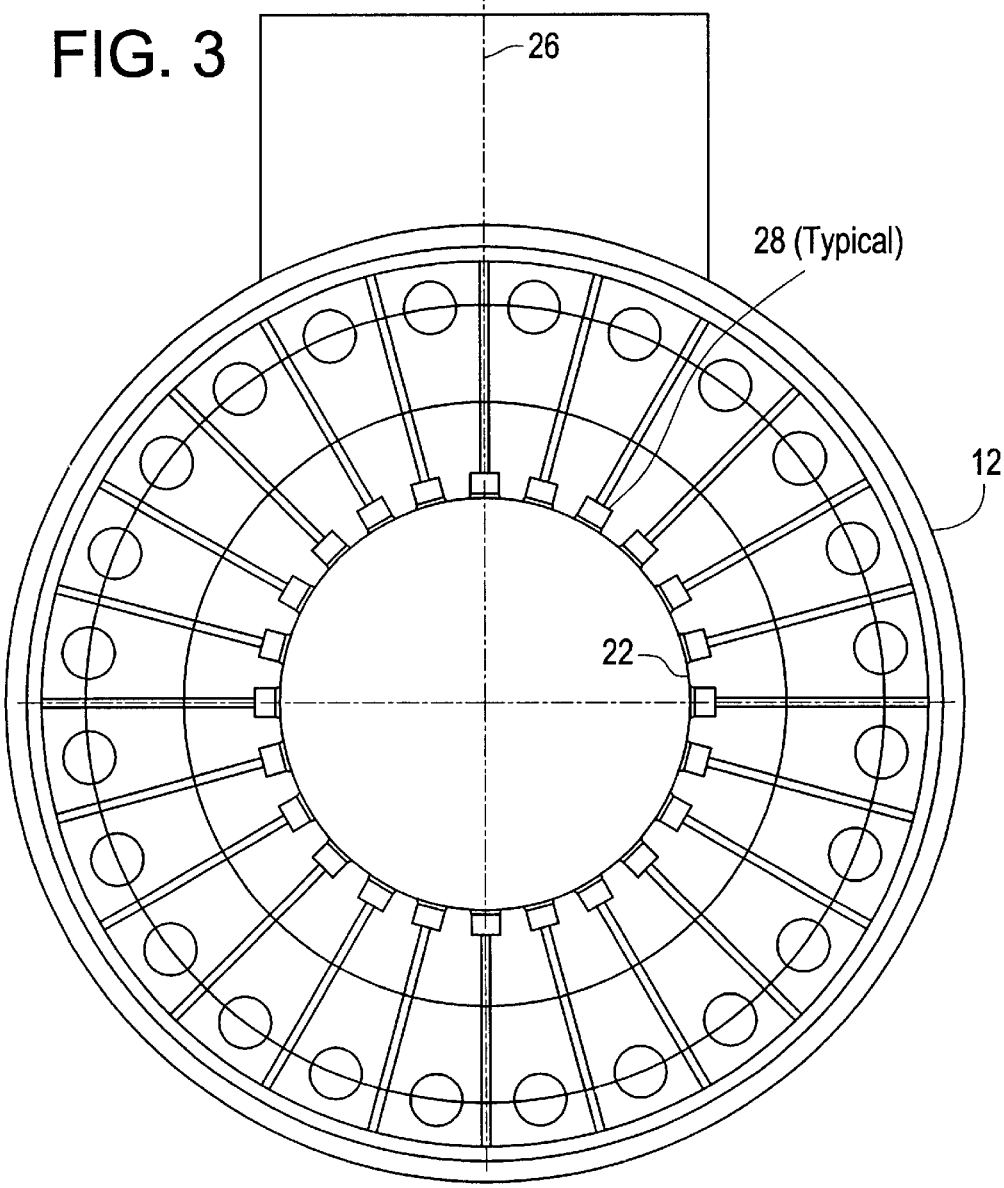
FIG. 3 is a plan view in section of the instrumented flange showing the positioning of the sensor units therein.

As best seen in FIGS. 2 and 3, sensor units 24 are positioned in counterbored pockets 28 in bore or conduit 22. The output signals of sensor units 24 are transmitted along wires 30 (not shown) that exit radially from instrumented flange or outer container 12. Seals are positioned at the rear of pockets 28 to maintain the pressure containment integrity of flange 12 and drilling riser 20. The output signals of sensor units 24 are sent to a signal processing unit (not shown) mounted on subsea blowout prevent stack 10 where the output signals of the sensor units are processed. This processed information is then transmitted to a display unit at the surface whereby an operator can determine the profile and position of a well component as it passes through the instrumented flange.

Figure 4:
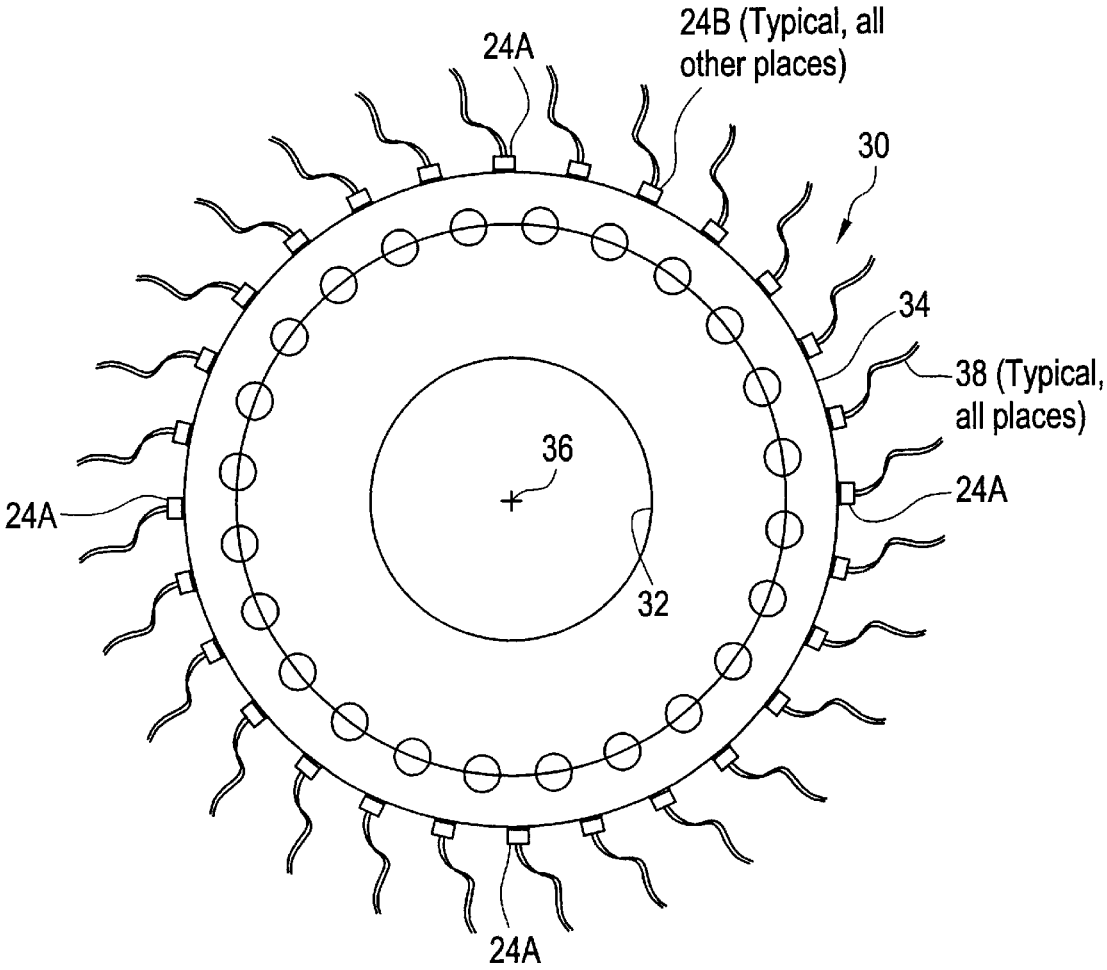
FIG. 4 is a plan view in section of an alternative embodiment of the instrumented flange showing the positioning of the sensor units exteriorly thereon.

An alternative embodiment of the apparatus and method for sensing the profile and position of a well component in a well bore is shown in FIG. 4. Those items which are the same as in the first embodiment retain the same numerical designations. In this alternative embodiment, instrumented flange or outer container 30 includes bore or conduit 32 extending therethrough. Conduit 32 is sized to match the bores of drilling riser 20 and subsea blowout prevent stack 10 to allow well components such as casing hangers, annular seal assemblies or downhole tools to pass unimpeded. Positioned about instrumented flange or outer container 30 on exterior surface 34 are a plurality of sensor units 24.

In this alternative embodiment, sensor units 24 may be acoustical or ultrasonic transducers, depending on the information to be obtained. A portion or first plurality of sensor units, denoted by 24A, are arranged circumferentially around exterior surface 34 in a single plane. A second portion or second plurality of sensor units, denoted by 24B, are arranged in a helical pattern extending around exterior surface 34 and along axis 36 of instrumented flange or outer container 30. The output signals of sensor units 24 are transmitted along wires 38 are sent to a signal processing unit (not shown) mounted on subsea blowout prevent stack 10 where the output signals of the sensor units are processed. This processed information is then transmitted to a display unit at the surface whereby an operator can determine the profile and position of a well component as it passes through the instrumented flange.

A typical method of use for instrumented flange or outer container 12 or 30 would be as follows. A first plurality of sensor units are arranged in the annular wall of flange 12 in a plane perpendicular to the axis of flange 12 and a second plurality of sensor units are arranged in the annular wall of flange 12 in pre-determined pattern such as a helix extending circumferentially around and axially along flange 12. The sensor units are sealed within flange 12 to maintain the pressure containment integrity of flange 12 and drilling riser 20. Flange 12 is installed in subsea blowout preventer stack 10 at the appropriate level and subsea blowout preventer stack 10 is lowered to a subsea wellhead positioned on the ocean floor. Subsea blowout preventer stack 10 is secured to the subsea wellhead by suitable means well known to those of ordinary skill in the art. As a well component is lowered through drilling riser 20 and into the bore of flange 12, sensor units 24 detect the presence and profile of well component. The output signals of the sensor units are transmitted to the signal processing unit on the blowout preventer stack. The signal processing unit processes the information and transmits the position and profile of the well component to a display unit positioned at the water surface which in turn displays the position and profile of said well component for evaluation by the operator. An operator having this information can make an informed decision as to whether a well component is in position and which well component it is.

The construction of my apparatus and method for sensing the profile and position of a well component will be readily understood from the foregoing description and it will be seen that I have provided an apparatus and method for sensing the profile and position of a well component in a well bore utilizing acoustic, ultrasonic or optical sensors and thereby be able to sense both non-magnetic and magnetic well components. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A system for sensing an object's profile and position relative to a container, comprising:

an outer container having a conduit therethrough;

a plurality of sensor units arranged within said outer container conduit, a portion of said plurality of sensor units lie in a plane perpendicular to the axis of said outer container, the remaining portion of said plurality of sensor units are arranged in a helical pattern within said outer container;

an object positioned within said outer container conduit, and;

said plurality of sensor units sensing said object's position and movement relative to said outer container when said object is within said outer container bore.

2. A system for sensing an object's profile and position relative to a container according to claim 1, wherein:

said plurality of sensors are acoustic transducers.

3. A system for sensing an object's profile and position relative to a container according to claim 2, wherein:

said plurality of sensors are positioned radially within counterbored pockets on the interior wall of said outer container; and, said counterbored pockets are sealed to maintain pressure within said outer container.

4. A system for sensing an object's profile and position relative to a container according to claim 3, wherein:

said outer container is a flange, said flange positioned in a blowout preventer stack.

5. A system for sensing an object's profile and position relative to a container according to claim 4, wherein:

the output signals of said plurality of acoustic transducers are transmitted to a processing unit positioned on said blowout preventer stack.

6. A system for sensing an object's profile and position relative to a container according to claim 1, wherein:

said plurality of sensors are ultrasonic transducers.

7. A system for sensing an object's profile and position relative to a container according to claim 6, wherein:

said plurality of sensors are positioned radially within counterbored pockets on the interior wall of said outer container; and, said counterbored pockets are sealed to maintain pressure within said outer container.

8. A system for sensing an object's profile and position relative to a container according to claim 7, wherein:

said outer container is a flange, said flange positioned in a blowout preventer stack.

9. A system for sensing an object's profile and position relative to a container according to claim 8, wherein:

the output signals of said plurality of acoustic transducers are transmitted to a processing unit positioned on said blowout preventer stack.

10. A system for sensing an object's profile and position relative to a container according to claim 1, wherein:

said plurality of sensors are optical sensors.

11. A system for sensing an object's profile and position relative to a container according to claim 10, wherein:

said plurality of optical sensors are positioned radially within counterbored pockets on the interior wall of said outer container; and, said counterbored pockets are sealed to maintain pressure within said outer container.

12. A system for sensing an object's profile and position relative to a container according to claim 11, wherein:

said outer container is a flange, said flange positioned in a blowout preventer stack.

13. A system for sensing an object's profile and position relative to a container according to claim 12, wherein:

the output signals of said plurality of optical sensors are transmitted to a processing unit positioned on said blowout preventer stack.

14. A system for sensing an object's profile and position relative to a container, comprising:

an outer container having a conduit therethrough;

a plurality of sensor units arranged about said outer container conduit, a portion of said plurality of sensor units lie in a plane perpendicular to the axis of said outer container, the remaining portion of said plurality of sensor units are arranged in a helical pattern about said outer container;

an object positioned within said outer container conduit, and;

said plurality of sensor units sensing said object's position and movement relative to said outer container when said object is within said outer container bore.

15. A system for sensing an object's profile and position relative to a container according to claim 14, wherein:

said plurality of sensors are acoustic transducers.

16. A system for sensing an object's profile and position relative to a container according to claim 15, wherein:

said outer container is a flange, said flange positioned in a blowout preventer stack.

17. A system for sensing an object's profile and position relative to a container according to claim 16, wherein:

the output signals of said plurality of acoustic transducers are transmitted to a processing unit positioned on said blowout preventer stack.

18. A system for sensing an object's profile and position relative to a container according to claim 14, wherein:

said plurality of sensors are ultrasonic transducers.

19. A system for sensing an object's profile and position relative to a container according to claim 18, wherein:

said outer container is a flange, said flange positioned in a blowout preventer stack.

20. A system for sensing an object's profile and position relative to a container according to claim 19, wherein:

the output signals of said plurality of ultrasonic transducers are transmitted to a processing unit positioned on said blowout preventer stack.

21. A method for sensing the position and profile of an object in a riser used in oil and gas drilling operations, including the steps of:

arranging a first plurality of sensor units in the annular wall of a flanged member in a plane perpendicular to the axis of said flanged member;

arranging a second plurality of sensor units in the annular wall of said flanged member in a helical pattern;

sealing said first plurality and said second plurality of sensor units within said annular wall of said flanged member to maintain the pressure containment integrity of said flanged member;

installing said flanged member in a blowout preventer stack;

directing the output signals of said sensor units to a processing unit on said blowout preventer stack;

lowering said blowout preventer stack on a running string to a subsea wellhead;

securing said blowout preventer stack to said subsea wellhead;

lowering a well component through said riser into the bore of said flanged member;

sensing the position and profile of said well component as it moves through said flanged member by the output of said first plurality and said second plurality of sensor units.

22. A method for sensing the position and profile of an object in a riser used in oil and gas drilling operations according to claim 21, further including the steps of:

transmitting the position and profile of said well component from said processing unit to a display unit positioned at the water surface;

displaying the position and profile of said well component on said display unit.

* * * * *